US005111786A

United States Patent [19]

Fontichiaro et al.

[11] Patent Number: 5,111,786

[45] Date of Patent: May 12, 1992

[54] AIR CELL FOR AN INTERNAL COMBUSTION ENGINE

[75] Inventors: Dominic Fontichiaro, Dearborn Heights; Daniel M. Kabat, Oxford, both of Mich.

[73] Assignee: Ford Motor Company, Dearborn, Mich.

[21] Appl. No.: 695,064

[22] Filed: May 3, 1991

[51] Int. Cl.[5] ..... F02B 19/18

[52] U.S. Cl. ..... 123/256; 123/255; 123/268; 123/293

[58] Field of Search ..... 123/26, 250, 255, 256, 123/262, 268, 285, 293, 316

[56] References Cited

U.S. PATENT DOCUMENTS

| | | | |
|---|---|---|---|
| 1,172,472 | 2/1916 | McCornack | 123/73 AA |
| 1,664,782 | 4/1928 | Magdeburger | 123/61 R |
| 1,703,653 | 2/1929 | Barrett | 123/302 |
| 1,816,432 | 7/1931 | Hill | 123/268 X |
| 1,941,805 | 1/1934 | Lang | 123/256 |
| 1,944,352 | 1/1934 | Lang | 123/256 X |
| 2,010,028 | 8/1935 | Martin | 123/268 X |
| 2,231,392 | 2/1941 | McCarthy . | |
| 2,244,749 | 6/1941 | Ware | 123/52 M |
| 2,305,208 | 12/1942 | Trammell, Sr. et al. | 123/309 |
| 2,593,769 | 4/1952 | Kollsman | 123/255 |
| 3,238,930 | 3/1966 | von Seggern et al. | 123/255 X |
| 3,304,922 | 2/1967 | Hideg | 123/255 X |
| 4,133,542 | 1/1979 | Janian et al. | 277/152 |
| 4,162,661 | 7/1979 | Nakanishi et al. | 123/307 |
| 4,290,614 | 9/1981 | Moll | 277/205 |
| 4,483,289 | 11/1984 | Paul et al. | 123/263 |

*Primary Examiner*—Willis R. Wolfe

*Attorney, Agent, or Firm*—Jerome R. Drouillard; Roger L. May

[57] ABSTRACT

An internal combustion engine having an air cell combustion system includes a cylinder block having at least one bore with a piston reciprocably housed therein, and a cylinder head attached to a cylinder block, with the cylinder block, piston and cylinder head defining a combustion chamber. A reservoir for air compressed by the piston is delimited by a counterbore in the deck surface of the cylinder block and by an annular space formed in the cylinder head. A number of passages extend tangentially from the reservoir into the combustion chamber.

10 Claims, 2 Drawing Sheets

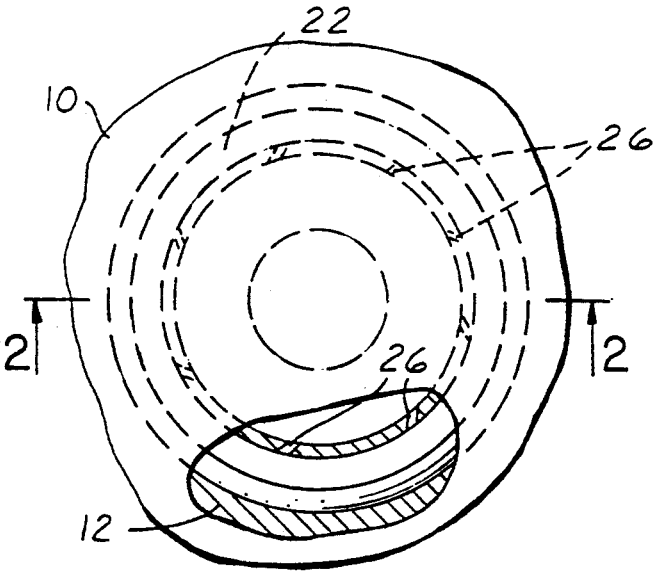
FIG. 1
FIG. 2
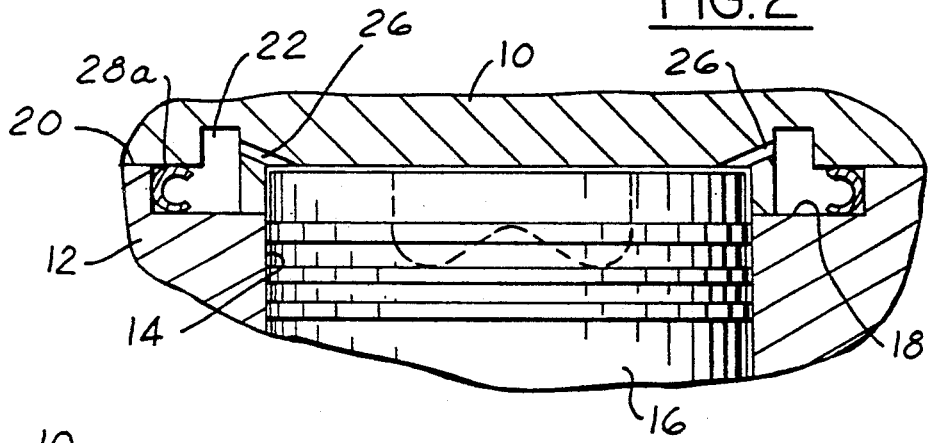
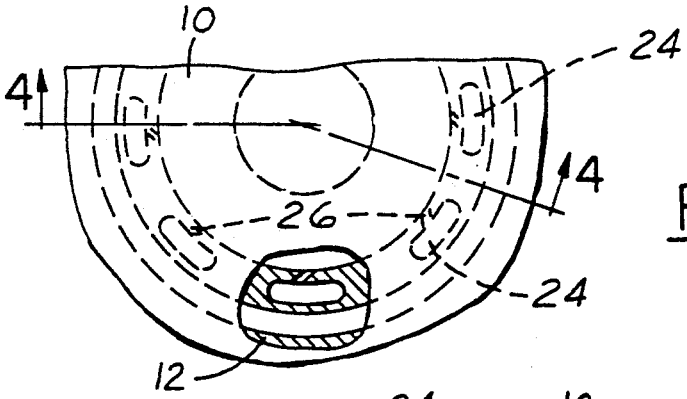
FIG. 3
FIG. 4
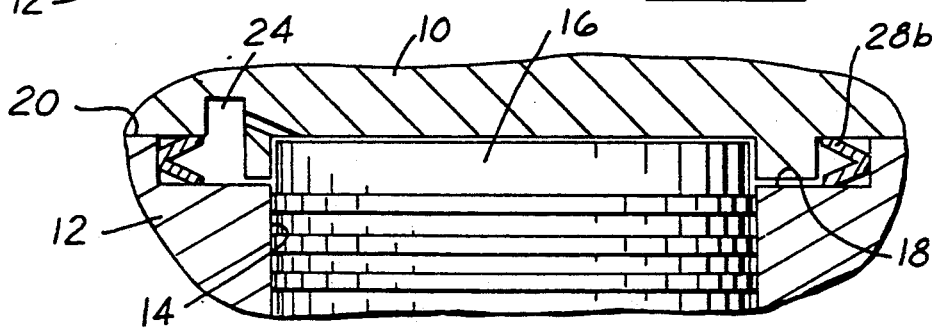

AIR CELL FOR AN INTERNAL COMBUSTION ENGINE

BACKGROUND OF THE INVENTION

1. Field of the Invention

This invention relates to an air cell for an internal combustion engine in which air contained in the main volume of the combustion chamber is augmented by additional air compressed into an auxiliary volume by the piston. During the engine's expansion stroke, the pressure in the main volume of the combustion chamber decreases, and the air within the air cell is discharged through a plurality of jets and allowed to bore into the combustion products within the main combustion chamber, thereby providing additional air, and sometimes fuel, for combustion. The discharge of air provides additional turbulence and enhances swirl, which promotes complete combustion.

2. Disclosure Information

The *Society of Automotive Engineers Technical Publication* 831297 discloses an air cell direct injection diesel engine, in which the air cell comprises a relatively massive affair taking a good deal of the space within the cylinder head. The cell is housed entirely within the cylinder head and has only a single nozzle for admitting the contents of the cell into the main combustion chamber.

U.S. Pat. No. 4,483,289 to Paul et al. discloses a prechamber diesel engine which, too, has a relatively massive chamber housed within the cylinder head, with but a single nozzle for discharging the contents of the prechamber into the main combustion chamber.

It is an object of the present invention to provide an air cell for an internal combustion engine which is compact and relatively easily manufactured, but which produces superior results by providing a plurality of passages for admitting the contents of the cell into the combustion chamber.

U.S. Pat. No. 1,703,653 to Barrett discloses an air cell having a uniflow design in which air is extracted from the cylinder through a first set of passages disposed about the outer periphery of the combustion chamber and subsequently conducted through such discrete passages to an annular supply chamber disposed about a centrally mounted fuel injector. A second plurality of passages extending from the annular space causes air to impinge upon the fuel spray emanating from the injector. Unfortunately, because of the lengths of the passages and the presence of such flow obstructing devices as check valves, the device shown in the '653 patent would be expected to perform poorly, while being expensive and difficult to construct, because of the need for numerous supply passages and associated valves wholly within the cylinder head. Also, because air is discharged about the centerline of the cylinder, mixing of the air with the contents of the combustion chamber will not be nearly as complete as with the design of the present invention, in which the air is discharged about the outer periphery of the combustion chamber.

U.S. Pat. No. 2,305,208 to Trammell, Sr., et al. discloses a cylinder having an inset defining a passage into the combustion chamber from which a jet of high velocity burning material bores into the combustion chamber after passing over a specially modified spark plug. The device of the '208 patent is asymmetrical, and its association with a spark plug prevents its use with a plurality of jets entering the combustion chamber. As with other single entry designs, the efficiency of operation would be hampered by the inability to obtain good mixing of the entire supplementary air charge.

Automotive designers have used various piston and combustion chamber designs for producing swirl within the combustion chamber U S. Pat. No. 3,658,046 to Winkler and U.S. Pat. No. 4,162,661 to Nakanishi et al. disclose but two such examples, neither of which provide an air cell action in which air is supplied to a primary combustion chamber after a piston has begun its downward stroke.

Engine designers have used port liners with inlet ports having different configurations as yet another means to increase swirl within the cylinder. U.S. 1,172,472 to McCornak, U.S. Pat. No. 1,664,782 to Magdeburger, U.S. Pat. No. 2,231,392 to McCarthy, and U.S. Pat. No. 2,244,749 to Ware disclose inlet ports in cylinders so as to cause swirl. None of these arrangements, however, can provide additional air once the piston has moved upwardly in the cylinder a sufficient height to cut off the inlet ports.

It is an object of the present invention to provide an air cell which is both compact and easily manufactured.

It is yet another object of the present invention to provide an air cell system which has multiple air jets for the purpose of enhancing the delivery of the air contained within the cell to the primary combustion chamber in multiple locations, whereby a more even delivery of air is achieved than with prior air cells.

It is an advantage of the present invention that the present system obviates the need for a conventional cylinder head gasket.

Other objects, features and advantages of the present invention will become apparent to the reader of this specification.

SUMMARY OF THE INVENTION

An internal combustion engine having an air cell combustion system includes a cylinder block having at least one bore with a piston reciprocably housed therein and a cylinder head attached to the cylinder block. The cylinder head, piston and cylinder block define a combustion chamber. A reservoir for air compressed by the piston is delimited by a concentric counterbore in the deck surface of the cylinder block and by an annular space formed in the cylinder head in communication with the counterbore. A plurality of passages or jets extends from the air reservoir into the combustion chamber. The passages may extend radially or tangentially inwardly into the combustion chamber, preferably from the outer periphery of the combustion chamber. The annular space contained within the cylinder head may comprise a plurality of individual antechambers or only a single unitary chamber. In the event that a plurality of individual antechambers is used, at least one passage or jet will extend from each of the antechambers into the combustion chamber. A compression seal may be interposed between the cylinder head and the cylinder block at the outer periphery of the counterbore.

In another embodiment of the present invention, a reservoir for air compressed by the piston is delimited by an annular space formed in the cylinder head and by the deck surface of the cylinder block. Depending upon the type of compression seal employed according to the present invention, such a seal may itself comprise a portion of the structure delimiting the reservoir for compressed air.

BRIEF DESCRIPTION OF THE DRAWINGS

FIG. 1 is a plan view of an engine having an air cell according to the present invention. It should be noted that none of the figures illustrates any type of valve arrangement, it being understood that the valve mechanism chosen for employment with an engine according to the present invention is a matter which lies outside the scope of this invention.

FIG. 2 is a sectional view of an engine having an air cell according to the present invention, taken along the line 2—2 of FIG. 1.

FIG. 3 is a plan view of a second embodiment according to the present invention, in which the air cell system comprises a segmented series of antechambers.

FIG. 4 is a sectional view taken along the line 4—4 of FIG. 3.

DETAILED DESCRIPTION OF THE PREFERRED EMBODIMENTS

Figure 5:
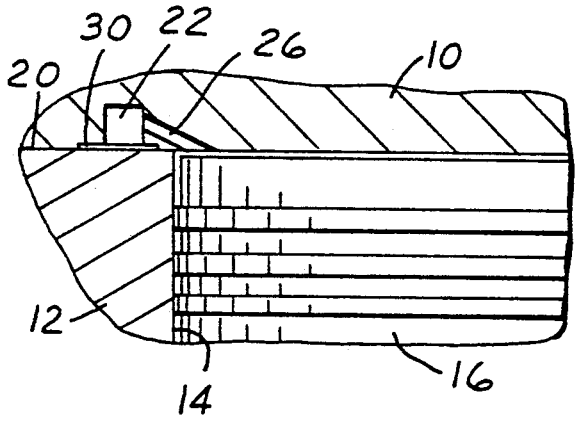
FIG. 5 is a sectional view of yet another embodiment according to the present invention, in which a reservoir for receiving air compressed by the piston is comprised wholly by an annular space formed in the cylinder head of the engine.

As shown in the various figures, a cylinder block, 12, having a bore, 14, slidably houses a piston, 16, therein. The bore is capped by cylinder head 10. Although engine valves are not illustrated in the various figures, those skilled in the art will appreciate that valves of varying numbers and types could be positioned in a plurality of locations in the cylinder head. Moreover, a fuel injector could also be positioned in the cylinder head or in the inlet manifold of the engine. These details are not part of the present invention.

FIGS. 1 and 2 illustrate a first embodiment of the present invention in which a reservoir for air compressed by the piston is delimited and defined by a concentric counterbore, 18, formed in deck surface 20 of cylinder block 12. The reservoir is further defined by annular space 22 which is formed in cylinder head 10. Annular space 22 and counterbore 18 are concentric with the longitudinal centerline of cylinder bore 14. The volume or reservoir defined by annular space 22 and counterbore 18 receives air through a plurality of passages or jets, 26, extending from the volume radially and tangentially inward into the combustion chamber. As illustrated in the figures, passages 26 extend into the outer periphery of the combustion chamber. As piston 16 compresses air in the cylinder, a fraction of the air moves through passages 26 into the reservoir defined by space 22 and counterbore 18. After the expansion stroke begins and the piston is descending in the cylinder, air will flow outwardly through passages 26 when the pressure drops in the cylinder. This additional air will help to promote complete combustion of the fuel, thereby reducing the production of undesirable engine emissions. Those skilled in the art will appreciate in view of this disclosure that the air contained within a reservoir according to the present invention could contain some fuel, depending upon the type of engine with which this invention is employed. In any event, the term "air", as used herein means not only fresh air inducted by the engine, but also air combined with fuel or other agents.

FIG. 2 shows a first type of compression seal, **28*a*, which is formed as a continuous C-section compression seal interposed between cylinder head 10 and cylinder block 12 in the location of counterbore 18. This seal functions to prevent gas from moving from the air reservoir into another part of the engine. As such, seal 28*a*** obviates the need for a conventional cylinder head gasket.

FIGS. 3 and 4 illustrate a second embodiment of an air cell combustion according to the present invention, in which a plurality of individual antechambers, 24, supplants continuous annular space 22 illustrated in the embodiment of FIGS. 1 and 2. Each antechamber 24 has at least one passage 26 extending therefrom into the combustion chamber of the engine. As before, each reservoir is delimited by a structure in cylinder head 10, in this case antechambers 24, working in concert with counterbore 18. The volume of antechambers 24 can be selected to obtain the desired effect on combustion.

FIG. 4 illustrates a second type of compression seal, **28*b*, interposed between cylinder head 10 and the counterbore section of cylinder block 12**. In this case, the seal comprises a V-shaped cross-section which is crushed between the cylinder head and the counterbore area of the block to obtain the necessary sealing to prevent the leakage of gases from the reservoir to the remaining areas of the engine.

FIG. 5 illustrates a third embodiment of an air cell combustion system according to the present invention. In this last embodiment, the reservoir is delimited by annular space 22 formed in the cylinder head 10 and by deck surface 20 of the cylinder block. In the absence of a counterbore, a flat gasket, 30, which is interposed between deck surface 20 and cylinder head 10, serves to prevent the leakage of air and combustion gases from the combustion chamber and reservoir into other regions of the engine. Gasket 30 eliminates the need for a conventional cylinder head gasket. As before, a plurality of passages 26 extends from the reservoir into the combustion chamber at the periphery of the combustion chamber. As with the other illustrated embodiments, annular space 22 is formed in the cylinder head at a location which is outboard of cylinder bore 14.

All of the illustrated embodiments show a beneficial air cell system which is marked by ease of manufacturing and superior function due to the use of a plurality of tangentially extending jets which introduce swirling air about the periphery of the combustion chamber so as to yield the maximum benefit in terms of improved combustion per unit volume of the air reservoir. An air cell system according to this invention readily lends itself to manufacturing because the reservoir volume is defined by spaces which are readily formed by casting or machining without the need for exotic manufacturing techniques.

While the invention has been shown and described in its preferred embodiments, it will be clear to those skilled in the arts to which they pertain that many changes and modifications may be made thereto without departing from the scope of the invention.

We claim:

1. An internal combustion engine having an air cell combustion system, comprising:

a cylinder block having at least one bore, with a piston reciprocably housed therein;

a cylinder head attached to said cylinder block and defining a primary combustion chamber with said cylinder block and piston;

a reservoir for air compressed by said piston, with said reservoir being delimited by:

a concentric counterbore in the deck surface of said cylinder block; and by a concentric annular space formed in said cylinder head and communicating with said counterbore; and by a compression seal interposed between said cylinder head and said cylinder block at the outer periphery of said counterbore, with said air cell further comprising a plurality of passages extending from said reservoir into said combustion chamber.

2. An internal combustion engine having an air cell combustion system, comprising:

a cylinder block having at least, one bore, with a piston reciprocably housed therein;

a cylinder head attached to said cylinder block and defining a combustion chamber with said cylinder block and piston;

a reservoir for air compressed by said piston, with said reservoir being delimited by a counterbore in the deck surface of said cylinder block, by an annular space formed in said cylinder head and communicating with said counterbore, and by a compression seal interposed between said cylinder head and said cylinder block at the outer periphery of said counterbore; and a plurality of passages extending from said reservoir into said combustion chamber.

3. An engine according to claim 2, wherein said passages extend tangentially inwardly into said combustion chamber.

4. An engine according to claim 2, wherein said passages extend into the outer periphery of said combustion chamber.

5. An engine according to claim 2, wherein said annular space comprises a plurality of individual antechambers, with at least one of said passages extending from each of said antechambers into the combustion chamber.

6. An engine according to claim 2, wherein said counterbore and said annular space are concentric with said cylinder bore.

7. An internal combustion engine having an air cell combustion system, comprising:

a cylinder block having at least one bore, with a piston reciprocably housed therein;

a cylinder head attached to said cylinder block and defining a combustion chamber with said cylinder block and piston;

a reservoir for air compressed by said piston, with said reservoir being delimited by an annular space formed in said cylinder head and by the deck surface of said cylinder block as well as by a compression seal interposed between said cylinder head and said cylinder block at the outer periphery of said annular space; and a plurality of passages extending from said reservoir into said combustion chamber.

8. An engine according to claim 7, wherein said passages extend tangentially into the outer periphery of said combustion chamber.

9. An engine according to claim 7, wherein said annular space comprises a plurality of individual antechambers, with at least one of said passages extending from each of said antechambers into the combustion chamber.

10. An engine according to claim 7, wherein said annular space is formed in said cylinder head at a location which is outboard of said cylinder bore.

* * * * *